US008041260B2

(12) United States Patent
Yoshida

(10) Patent No.: US 8,041,260 B2
(45) Date of Patent: Oct. 18, 2011

(54) MEMBER MOUNTING ARRANGEMENT

(75) Inventor: Takeshi Yoshida, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 1335 days.

(21) Appl. No.: 11/643,290

(22) Filed: Dec. 21, 2006

(65) Prior Publication Data

US 2007/0154252 A1 Jul. 5, 2007

(30) Foreign Application Priority Data

Dec. 28, 2005 (JP) ..... 2005-377461
Nov. 30, 2006 (JP) ..... 2006-324364

(51) Int. Cl.
*G03G 15/20* (2006.01)
*G03G 21/201* (2006.01)

(52) U.S. Cl. ..... 399/122; 399/69; 399/335

(58) Field of Classification Search ..... 399/13, 399/44, 47, 48, 49, 69, 122, 328, 335; 219/469, 219/470; 432/60, 228
See application file for complete search history.

(56) References Cited

U.S. PATENT DOCUMENTS 5,937,230 A * 8/1999 Iwase et al. ..... 399/69
6,549,740 B2 * 4/2003 Yoneda et al. ..... 399/122
6,671,471 B2 * 12/2003 Nakamura et al. ..... 399/69

FOREIGN PATENT DOCUMENTS

JP 60047932 A * 3/1985
JP 61091679 A * 5/1986
JP 03145684 A * 6/1991
JP 04336581 A * 11/1992
JP 2000356920 A * 12/2000
JP 2003-015463 1/2003
JP 2004013024 A * 1/2004
JP 2004240365 A * 8/2004
JP 2006195324 A * 7/2006

* cited by examiner

*Primary Examiner* — David Gray
*Assistant Examiner* — Fred L Braun
(74) *Attorney, Agent, or Firm* — The Webb Law Firm

(57) ABSTRACT

A member mounting arrangement mounts a proximity mounting member to a proximity object at a predetermined position relative thereto. The arrangement includes an intermediate fixing member attached to a fixing frame supporting the proximity object, the intermediate fixing member being adjustable in position in a direction to/from the proximity object, a fixing connecting portion attached to the intermediate fixing member while supporting the proximity mounting member, the fixing connecting portion being adjustable in position in the same direction as above, a regulating portion for regulating a separating distance between the proximity mounting member and the proximity object to a predetermined range, a first fixing portion for fixing the intermediate fixing member in position relative to the fixing frame, and a second fixing portion for fixing the fixing connecting portion in position relative to the intermediate fixing member.

3 Claims, 12 Drawing Sheets

MEMBER MOUNTING ARRANGEMENT

CROSS-REFERENCE OF RELATED APPLICATION

This application claims a priority based on Japanese Patent Application No. 2005-377461 and Japanese Patent Application No. 2006-324364, which were filed in Japan on Dec. 28, 2005 and on Nov. 30, 2006, respectively, both being assigned to this applicant. The disclosures of said related applications are incorporated herein by reference in their entireties.

BACKGROUND OF THE INVENTION

1. Field of the Invention

The present invention relates to an arrangement for mounting a proximity mounting member relative to a "proximity" object with a predetermined distance therebetween.

2. Description of Related Art

As known, an electronic photographic image forming apparatus such as a copier, a printer, a telefax, includes an image fixing section having a fixing roller incorporating an electric driven fixing heater and a thermostat operable to stop power supply to the fixing heater upon detection of abnormal heat-up of this roller, the thermostat having a temperature detecting portion for detecting the fixing roller temperature. The temperature detecting portion of the thermostat is spaced from an outer peripheral surface of the fixing roller for a predetermined distance so as not to damage this roller. The thermostat per se is mounted to e.g. a supporting frame of the fixing roller. With this arrangement, the thermostat can detect a temperature of atmosphere adjacent the outer peripheral surface of the fixing roller as the fixing roller temperature, in a non-contact manner.

Next, as an example of "member mounting arrangement" to which the invention pertains, there will be described the arrangement provided in the fixing section of the image forming apparatus described above for mounting the thermostat, as an example of "proximity mounting member", to the fixing roller, as an example of "proximity object" in such a manner that the temperature detecting portion of the former may be spaced apart from the outer peripheral surface of the fixing roller for a predetermined distance.

With the image forming apparatus, it is desired that a rise time required for the temperature of the fixing roller to rise from the normal (room) temperature to the image fixing temperature be as short as possible. It is also desired that the thermostat be mounted in close proximity of the fixing roller so as to allow the detection of the fixing roller temperature to be made with good responsiveness in a short period to the rise time.

With the conventional thermostat mounting arrangement in general, there is provided a housing having a cylindrical receiving portion for accommodating the thermostat therein and the thermostat is screw-fixed, with opposed terminal portions provided at the right and left extreme ends of the thermostat being placed in contact with the top face of the cylindrical receiving portion. Further, the housing for the thermostat is screw-fixed to the machine (apparatus) body so as to keep the temperature detecting portion of the thermostat away from the outer peripheral surface of the fixing roller for a predetermined distance (see e.g. Japanese Patent Application Laid-Open No. 2003-15463).

Accordingly, in order to allow speedy and highly responsive detection of the fixing roller temperature by minimizing the predetermined separating distance from the temperature detecting portion to the outer peripheral surface of the fixing roller, it is necessary to mount the thermostat with considerable degree of precision. Otherwise, i.e. if the mounting precision of the fixing roller is not so high, it becomes difficult to mount the thermostat, with maintaining the predetermined distance from the temperature detecting portion from the outer peripheral surface of the fixing roller. Then, the thermostat can sometimes contact the fixing roller inadvertently, due to displacement and/or vibration associated with the rotation of the fixing roller.

SUMMARY OF THE INVENTION

The present invention has been made in view of the above-described state of the art. A primary object of the invention is to provide a member mounting arrangement which allows a proximity mounting member to be mounted to a proximity object at a predetermined position relative thereto with high precision, so as to avoid mutual undesired contact therebetween.

[First Characterizing Construction]

According to a first characterizing construction of the member attaching arrangement relating to the present invention, a member mounting arrangement for mounting a proximity mounting member to a proximity object at a predetermined position relative thereto, the arrangement comprising:

an intermediate fixing member attached to a fixing frame supporting the proximity object, the intermediate fixing member being adjustable in position in a direction to/from the proximity object;

a fixing connecting portion attached to said intermediate fixing member while supporting the proximity mounting member, the fixing connecting portion being adjustable in position in said direction;

a regulating portion for regulating a separating distance between the proximity mounting member and the proximity object to a predetermined range;

a first fixing portion for fixing said intermediate fixing member in position relative to said fixing frame; and a second fixing portion for fixing said fixing connecting portion in position relative to said intermediate fixing member.

[Function/Effect]

With the member attaching arrangement constructed as above, as this arrangement includes an intermediate fixing member which is adjustable in position in the direction to/from the proximity object, the attaching position of the intermediate fixing member relative to the fixing frame can be adjusted as desired in said direction. In the above, the language "to/from the proximity object" is intended to be inclusive of a case where the fixing member is displaced (adjusted) perpendicularly to/from the surface of the proximity object, a further case where this displacement occurs with keeping a predetermined angle therebetween or a still further case where the displacement occurs with varying an angle (i.e. with a curve) therebetween Further, as the arrangement includes a fixing connecting portion attached to said intermediate fixing member while supporting the proximity mounting member, the fixing connecting portion being adjustable in position in said direction, the arrangement allows also desired adjustment of attaching position of the proximity mounting member relative to the intermediate fixing member in said direction.

The inventive arrangement further includes a first fixing portion for fixing the intermediate fixing member in position relative to the fixing frame and a second fixing portion for fixing the fixing connecting portion in position relative to the intermediate fixing member. With these, the intermediate fixing member which has been appropriately adjusted in position in the above-described direction can be fixed in position relative to the fixing frame in a reliable manner. Further, the fixing connecting portion which has been appropriately adjusted in position in the above-described direction can be fixed in position relative to the intermediate fixing member in a reliable manner also.

For effecting the above-described positioning operations, the inventive arrangement further includes a regulating portion for regulating a separating distance between the proximity mounting member and the proximity object to a predetermined range. With this, the separating distance between the proximity mounting member and the proximity object can be readily adjusted within the predetermined range, by bringing temporarily the proximity mounting member into contact with the proximity object with the intermediate fixing member being fixed to the fixing frame of the proximity object and then displacing this proximity mounting member in the direction away from the proximity object. Thereafter, the proximity mounting member will be fixed at the predetermined position and then the second fixing portion will be used for fixing the fixing connecting portion of the proximity mounting member to the intermediate fixing member. With this, the proximity mounting member can be mounted relative to the proximity object at a predetermined position in a reliable manner.

Therefore, even in the case of rather low mounting precision of the proximity object, inadvertent contact between the proximity object and the proximity mounting member can be avoided and the proximity mounting member can be mounted at the predetermined position relative to the proximity object with high precision.

[Second Characterizing Construction]

In the inventive member mounting arrangement described above, said regulating portion can include a slot provided in one of said intermediate fixing member and said fixing connecting portion and an engaging pawl provided in the other and engageable in said slot.

[Function/Effect]

With the above-described construction, the engagement, when realized, of the engaging pawl provided in one of the intermediate fixing member and the fixing connecting portion into the slot provided in the other functions as the regulating portion for regulating the separating distance between the proximity mounting member and the proximity object to the predetermined range. More particularly, as the outer surface of the engaging pawl comes into contact with the inner peripheral surface of the slot, relative displacement between fixing connecting portion formed integral with the proximity mounting member and the intermediate fixing member fixed to the fixing frame of the proximity object is regulated with the predetermined range. This construction of the regulating portion is advantageous as facilitating the attachment of the proximity mounting member at the predetermined position relative to the proximity object.

Incidentally, since the distance (separating or separable distance) between the proximity object and the proximity mounting member is determined by the relationship between the diameter of the slot and the width of the engaging pawl, the distance can be readily set to a desired value by appropriate selection of these sizes.

[Third Characterizing Construction]

In the inventive member mounting arrangement, said intermediate fixing member and said fixing connecting portion together provide a cam mechanism which is switchable between a contacting condition where the proximity mounting member is placed in contact with the proximity object and a separating condition where the proximity mounting member is placed away from the proximity object, said cam mechanism acting also as said regulating portion.

[Function/Effect]

With the above-described construction, with a simple operation of pivoting the cam mechanism provided in and between the intermediate fixing member and the fixing connecting portion, the contacting condition where the proximity mounting member is placed in contact with the proximity object can be readily switched over to the separating condition where these two are separated from each other.

Further, in the separating condition, since the separable distance between the proximity object and the proximity mounting member is determined by a cam profile of a cam member constituting the cam mechanism, the distance can be readily set to a desired value by appropriate selection of the cam profile.

[Fourth Characterizing Construction]

In the inventive member mounting arrangement, the arrangement can further comprise an urging member for urging said cam mechanism and said fixing connecting portion into contact with each other.

[Function/Effect]

With the above-described construction, as the arrangement further includes an urging member for urging said cam mechanism and said fixing connecting portion into contact with each other, the pivotal movement of the cam mechanism can be transmitted to the fixing connecting portion in a reliable manner.

Moreover, when the cam mechanism is inoperable, i.e. stopped, the urging force of the urging member is effective for reliably preventing mutual displacement between the intermediate fixing member and the fixing connecting portion. Hence, the positioning operation by the second fixing portion can be effected even more reliably and easily.

Further and other features and advantages of the invention will become apparent upon reading the following detailed description of presently preferred embodiments thereof with reference to the accompanying drawings.

DESCRIPTION OF PREFERRED EMBODIMENTS

Preferred embodiments of the invention will be described hereinafter with reference the accompanying drawings.

First Embodiment

Figure 1:
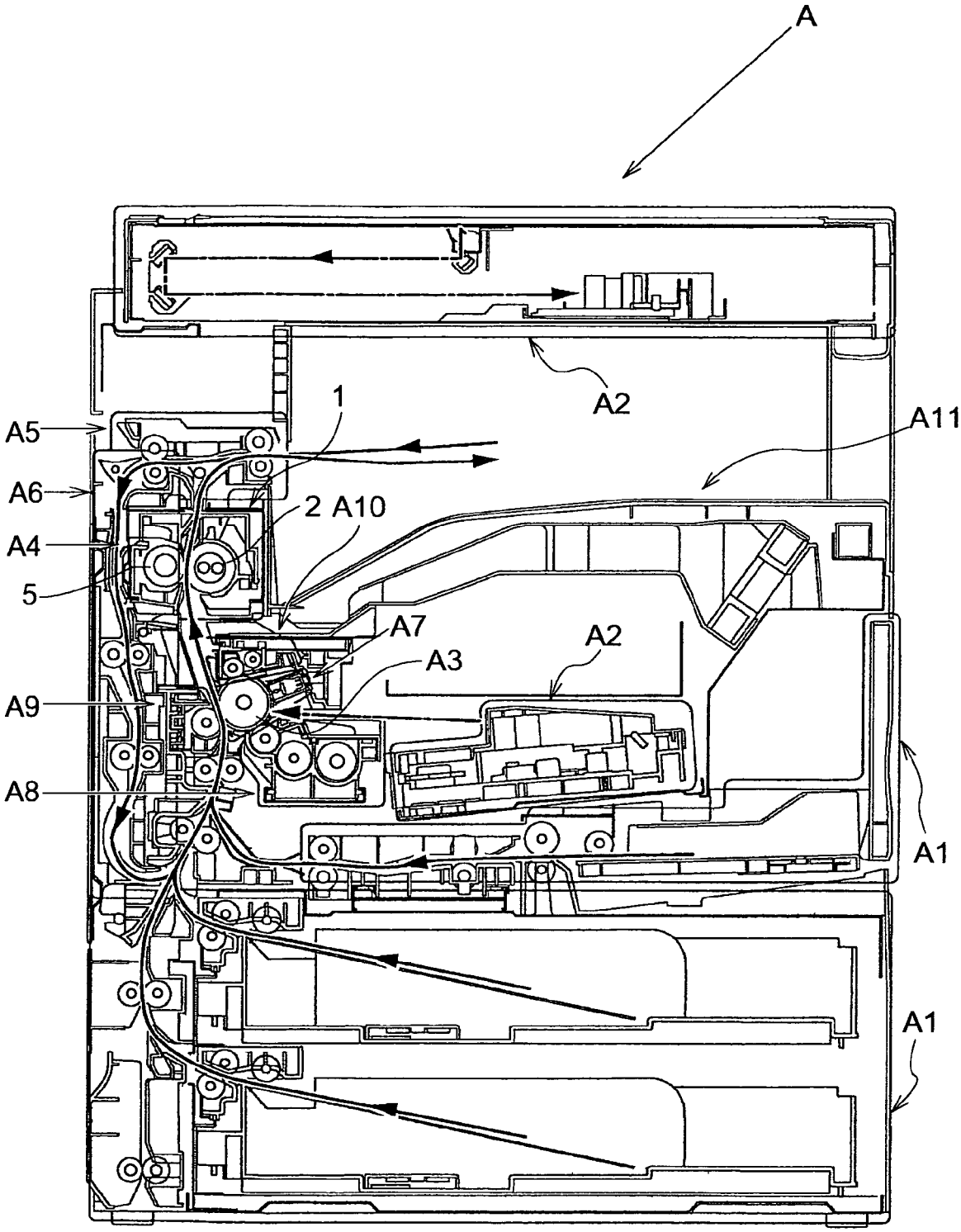
FIG. 1 is a side view showing inside of an image forming apparatus.

FIG. 1 shows a photo copier A as an example of an electro photographic image forming apparatus. This copier A includes a paper feeding section A1, an optical section A2, a photosensitive drum A3, a fixing section A4, a discharging/reversing section A5, a two-face section A6, etc. Around the photosensitive drum A3, there are provided a main charger section A7, a developing section A8, a transfer/separating section A9, a cleaning/charge-removing section A10, etc. In operation of this copier A, a toner image is formed on the photosensitive drum A3 based on image information read by the optical section A2, this toner image is then transferred to and fixed on a paper sheet fed from the paper feeding section A1 and thereafter, the resultant image-bearing paper sheet is discharged onto a paper discharging tray A11.

FIGS. 2 through 9 show a member mounting arrangement relating to the present invention to be provided in a fixing unit 1 constituting the fixing section A4, the arrangement allowing mounting of a thermostat 4 fixed to a bracket 3 relative to a fixing roller 2 with a predetermined separating distance B relative thereto. The thermostat 4 is one example of "proximity mounting member" and the fixing roller 2 is one example of "proximity object". In the technical concept of the present invention, the above language "predetermined position" is understood to mean such a position where undesired contact between the fixing roller 2 and the thermostat 4 can be reliably avoided AND a temperature detecting portion 13 of the thermostat 4 can reliably detect a surface temperature of the fixing roller 2. This predetermined position can vary appropriately, depending on various conditions such as the type, performance, use environment of the copier A.

Figure 2:
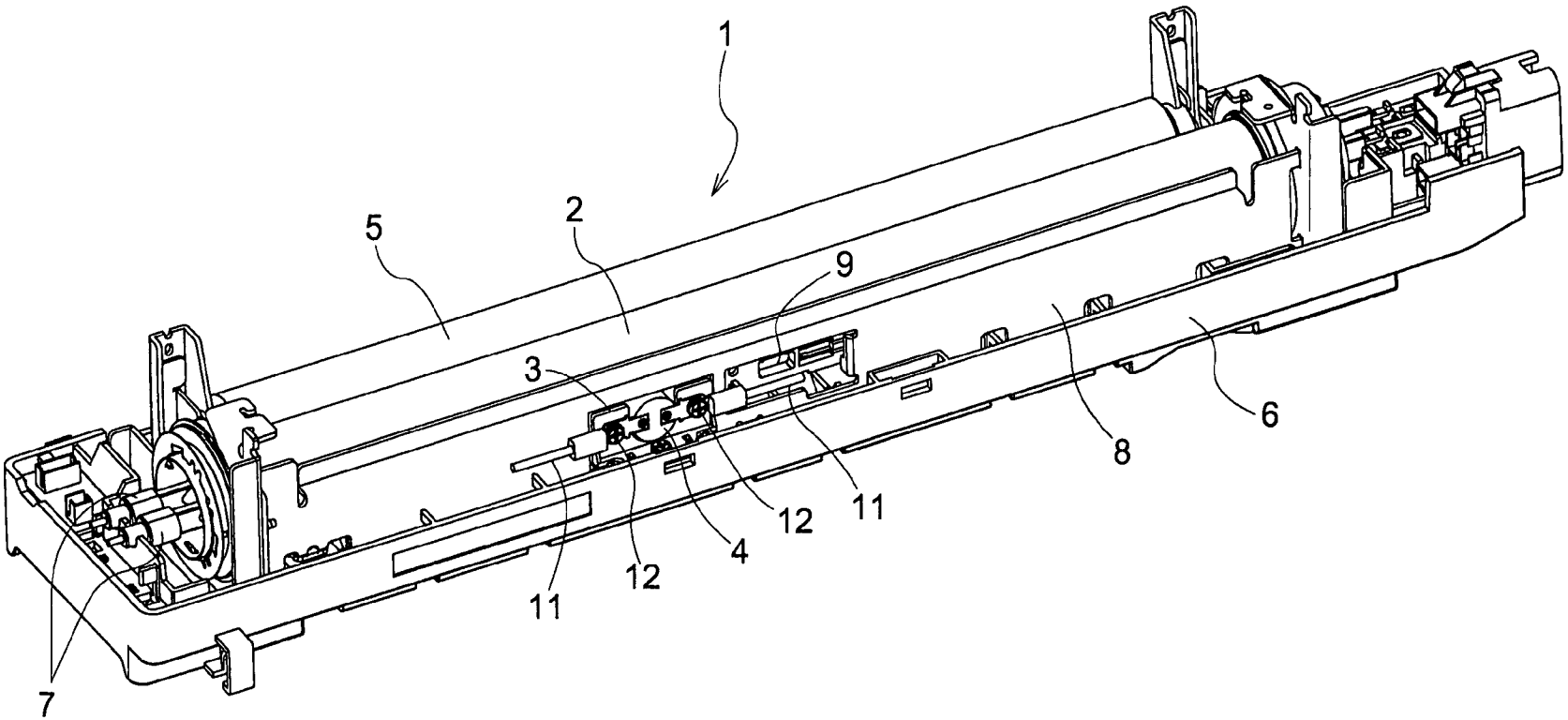
FIG. 2 is a perspective view showing a fixing unit.

In the fixing unit 1, as shown in FIG. 2, a press roller 5 and the cylindrical fixing roller 2 are disposed in parallel with each other and are rotatably supported to a machine frame 6 as an example of "fixing frame". The fixing roller 2 incorporates therein an electric driven fixing heater 7. Further, the machine frame 6 integrally includes a plate-like stay 8 which extends substantially in parallel with a rotational axis of the fixing roller 2. To this plate-like stay 8, there are mounted such components as a thermistor 9 for detecting the temperature of the fixing roller 2 and a thermostat 4 operable to shutoff power supply to the fixing heater 2 upon detection of abnormal temperature rise in the fixing roller 2.

Figure 3:
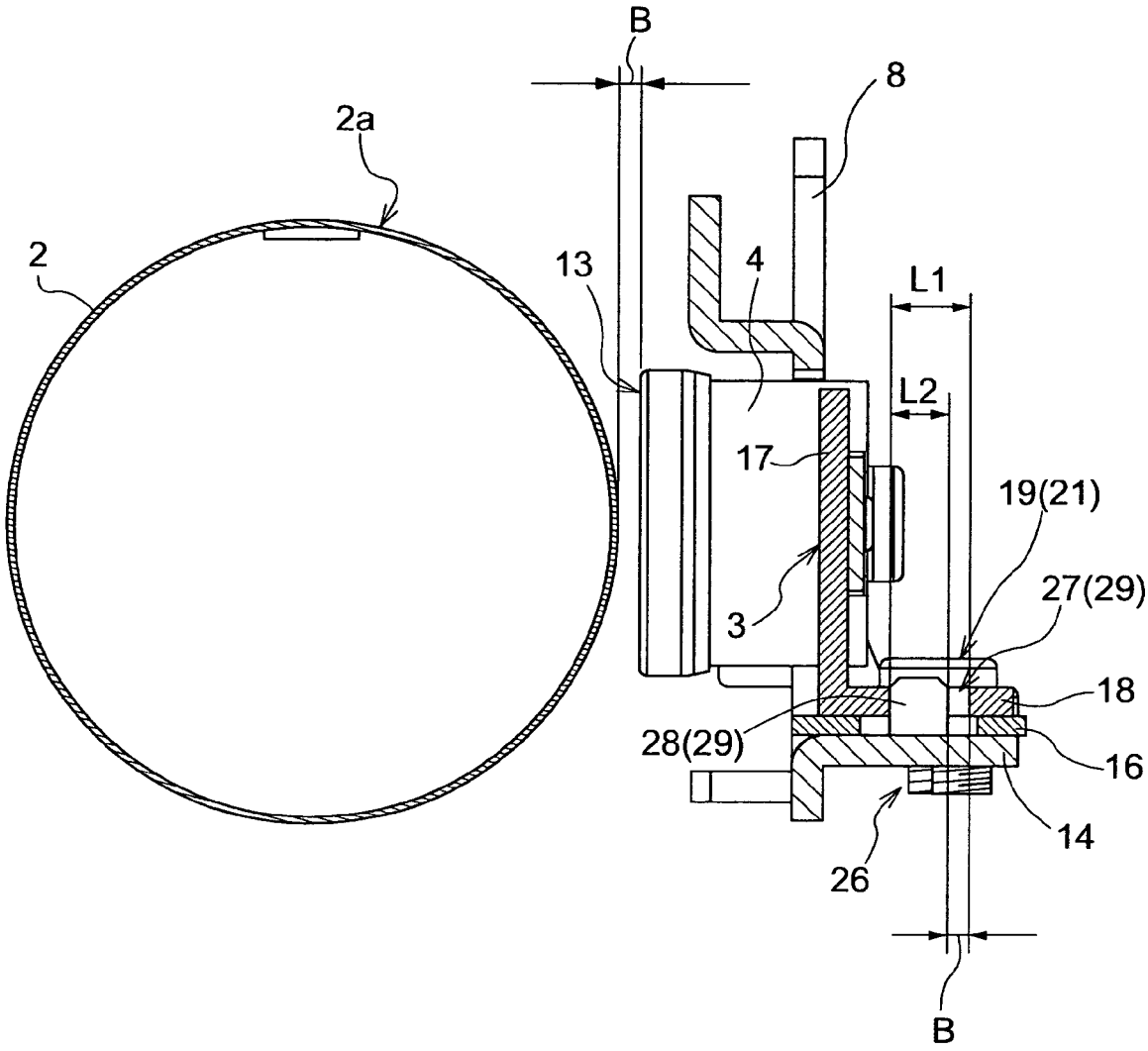
FIG. 3 is a vertical section of principal portions showing a member mounting arrangement according to one embodiment of the invention.

The thermostat 4 is fastened and fixed to the bracket 3 with screws 12 which fasten right and left terminals 10 and a heater wire 11 together. As shown in FIG. 3, the thermostat 4 includes a temperature detecting portion 13 for detecting the temperature of the fixing roller 2. The thermostat 4 is attached to the stay 8 in such a manner that the temperature detecting portion 13 is spaced from an outer peripheral surface 2*a* of the fixing roller 2 for a predetermined distance B. With this arrangement, the thermostat 4 is operable to detect a temperature of atmosphere present adjacent around the outer peripheral surface 2*a* of the fixing roller 2 as the temperature of the fixing roller 2.

Figure 4:
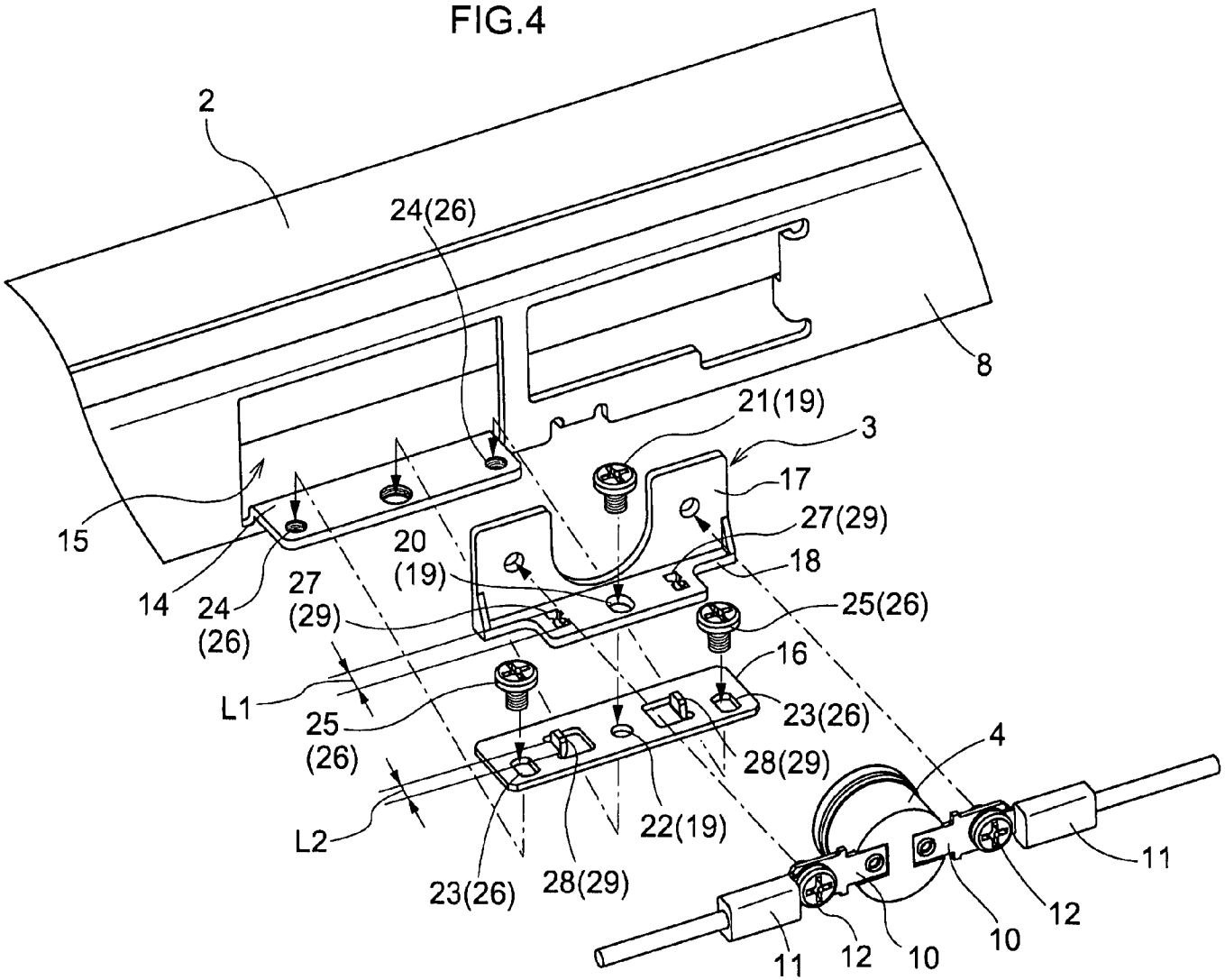
FIG. 4 is an exploded perspective view showing the member mounting arrangement.
Figure 5:
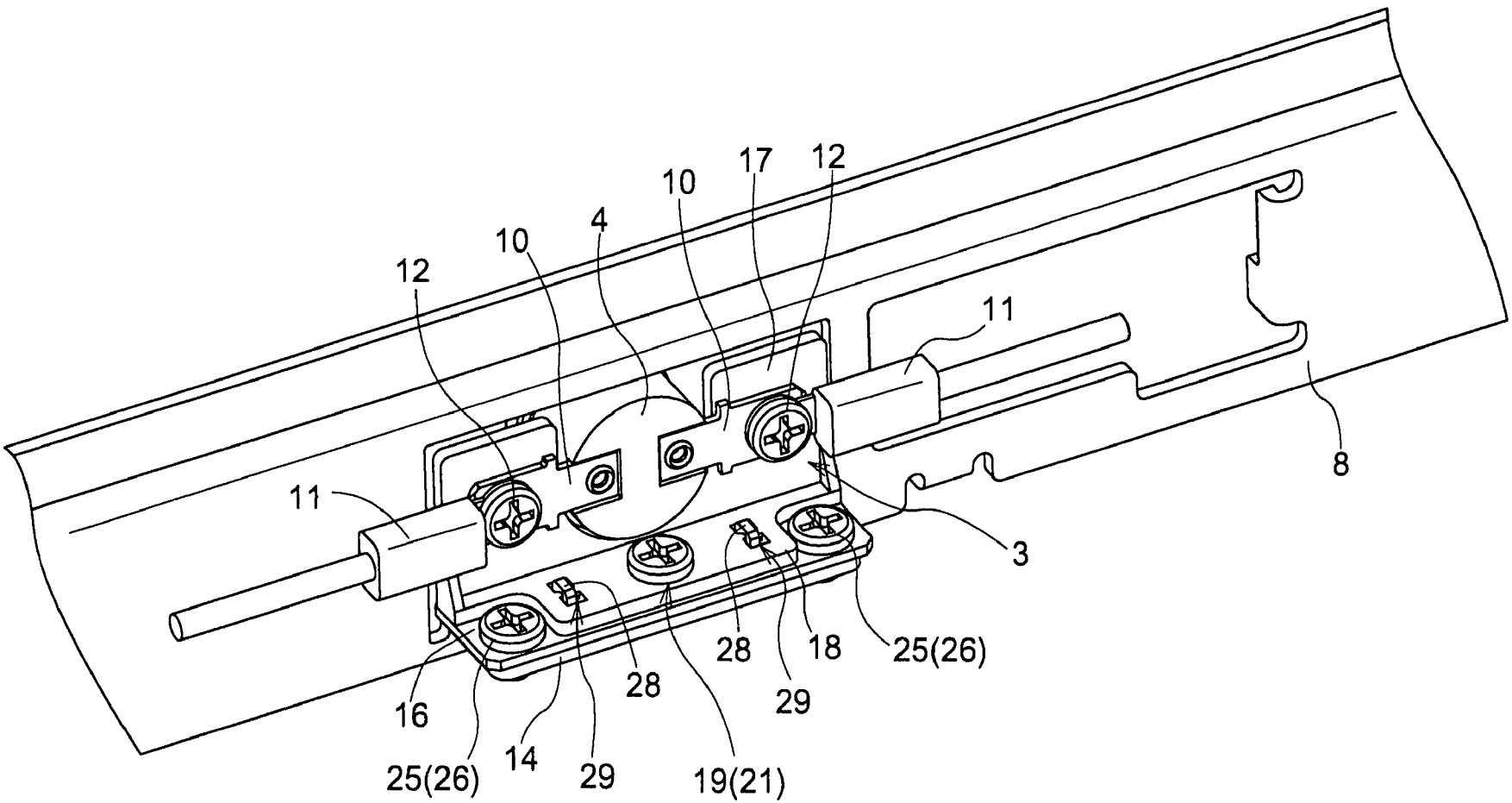
FIG. 5 is a perspective view showing the member mounting arrangement

The stay 8 includes, as a raised cut portion thereof, a thermostat fixing seat plate 14 and an opening 15 for causing the temperature detecting portion 13 to face the outer peripheral surface 2*a* of the fixing roller 2. As shown in FIG. 4 and FIG. 5, the bracket 3 to which the thermostat 4 is screw-fixed is fixed to the seat plate 14 via an adjusting plate 16 acting as an "intermediate fixing member".

The bracket 3 is an L-shaped integral structure consisting essentially of a first plate portion 17 to which the thermostat 4 is screw-fixed and a second plate portion 18 which is screw-fixed to the adjusting plate 16, with the first and second plate portions 17, 18 extending normal to each other. And, there is provided a second fixing portion 19 for immovably fixing the second plate portion 18 acting as a "fixing connecting portion" for the adjusting plate 16 for the thermostat 4, to the adjusting plate 16.

As shown in FIG. 4, the second plate portion 18 defines a bracket through hole 20, and a screw 21 inserted in this bracket through hole 20 is threaded into a female threaded hole 22 defined in the adjusting plate 16. With this, the second plate portion 18 is immovably screw-fixed to the adjusting plate 16 and fixed in position. In this way, the second fixing portion 19 is formed.

The adjusting plate 16 defines adjusting plate through holes 23 at right and left ends thereof, and the seat plate 14 defines female threaded holes 24 on the right and left ends thereof And, screws 25 inserted in the respective adjusting plate through holes 23 are threaded in the female threaded holes 24. With this, the adjusting plate 16 is immovably fixed, via the seat plate 14 formed in the stay 8, to the machine frame 6 acting as a "fixing frame" for the fixing roller 2 and fixed in position. In this way, a first fixing portion 26 is formed.

Each one of the adjusting plate through hole 23 is provided as a slot elongate in a direction to/away from the fixing roller 2 and normal to its outer peripheral surface 2*a*, and the adjusting plate 16 is constructed as the intermediate fixing member which is attached to be adjustable in position to/away from the fixing roller 2. Further, the range of its movement is set such that the temperature detecting portion 13 of the thermostat 4 can be brought into contact with the fixing roller 2 when the second plate portion 18 is attached to the adjusting plate 16.

Also, the bracket through hole 20 is provided as a slot elongate in a direction to/away from the fixing roller 2 and normal to its outer peripheral surface 2*a*, so that the second plate portion 18 is attached to the adjusting plate 16 to be adjustable in position in the same direction as the moving direction of the adjusting plate 16. The second plate portion 18 defines, at its right and left opposed ends, approximately rectangular slots 27, each having a length L1 in the direction to/away from the fixing roller 2 and normal to the outer peripheral surface 2*a*. Whereas, the adjusting plate 16 forms, as cut raised portions provided on the right and left opposed ends thereof, engaging pawls 28, each having a length L2 in the direction to/away from the fixing roller 2 and normal to the outer peripheral surface 2*a* thereof, the length L2 being shorter than the length L1 of the slot 27 for a predetermined distance B. With this, when each engaging pawl 28 is engaged in the associated slot 27, the outer surface of the engaging pawl 28 comes into contact with the inner peripheral surface of the slot 27, whereby the relative displacement between the thermostat 4 provided integral with the second plate portion 18 and the adjusting plate 16 fixed to the machine frame 6 for the fixing roller 2 is regulated within a predetermined range. In this way, there is realized a regulating means 29 for keeping the thermostat 4 whose temperature detecting portion 13 is in contact with the outer peripheral surface 2*a* of the fixing roller 2, away from the fixing roller 2 and regulating this separating distance B within the predetermined range.

Incidentally, the engaging pawls 28 may be formed in the second plate portion 18 and the slots 27 may be formed in the adjusting plate 16. And, such pawls and slots can together constitute the above-described regulating means 29.

Next, there will be described a process of attaching the thermostat 4 fixed to the bracket 3, to the seat plate 14.

Figure 6:
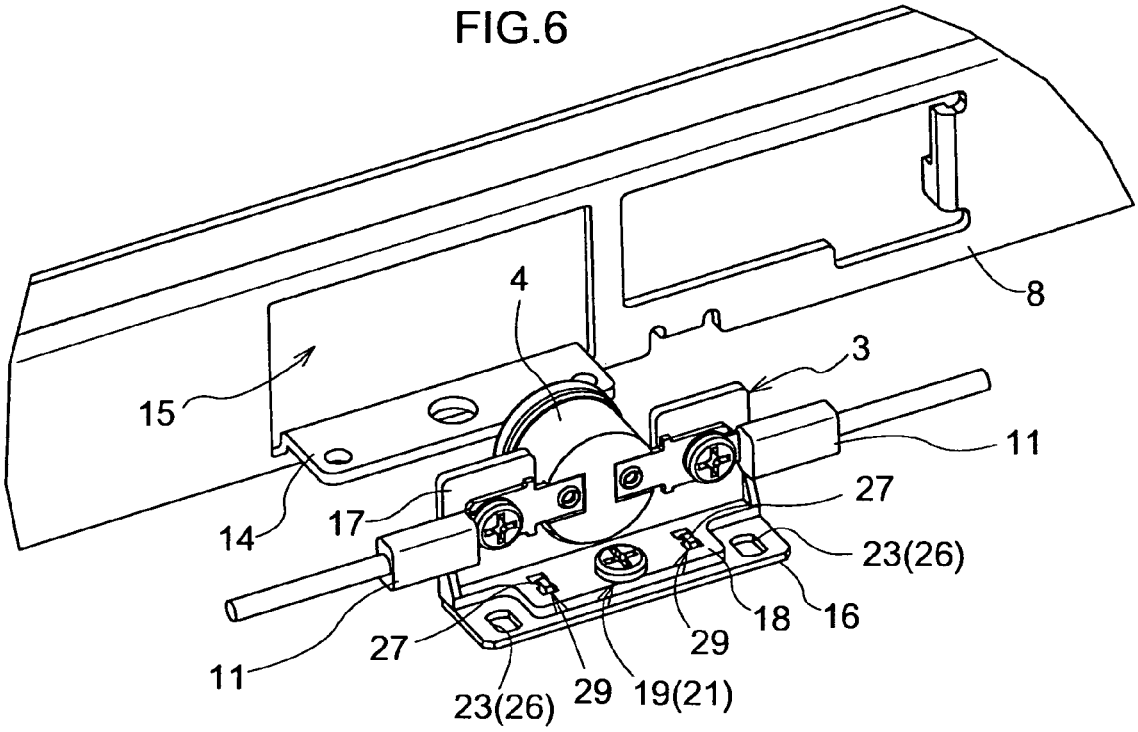
FIG. 6 is a perspective view illustrating a method of assembling the member mounting arrangement.
Figure 7:
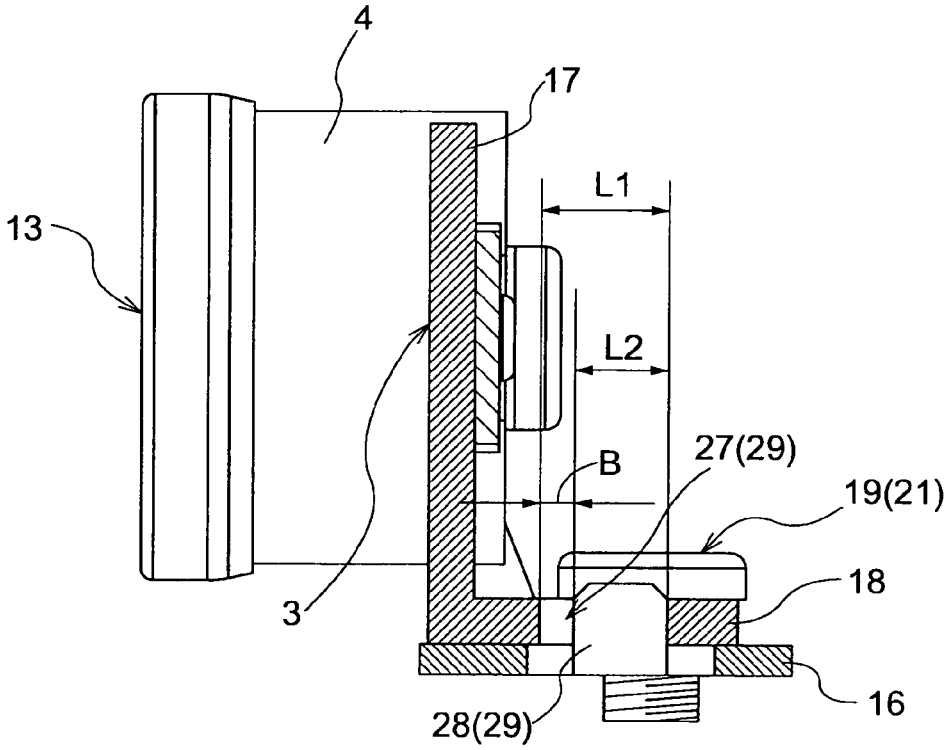
FIG. 7 is a vertical section of principal portions illustrating the method of assembling the member mounting arrangement.

As illustrated in FIG. 6 and FIG. 7, the right and left engaging pawls 28 of the adjusting plate 16 will be engaged in the right and left engaging slots 27 of the second plate portion 18. Then, with keeping each engaging pawl 28 in contact with the inner peripheral edge of the associated engaging slot 27 opposite to the first plate portion 17 side, the screw 21 inserted in the bracket through hole 20 will be threaded into the female threaded hole 22 of the adjusting plate 16. With this, the second plate portion 18 is immovably fastened and fixed to the adjusting plate 16.

Figure 8:
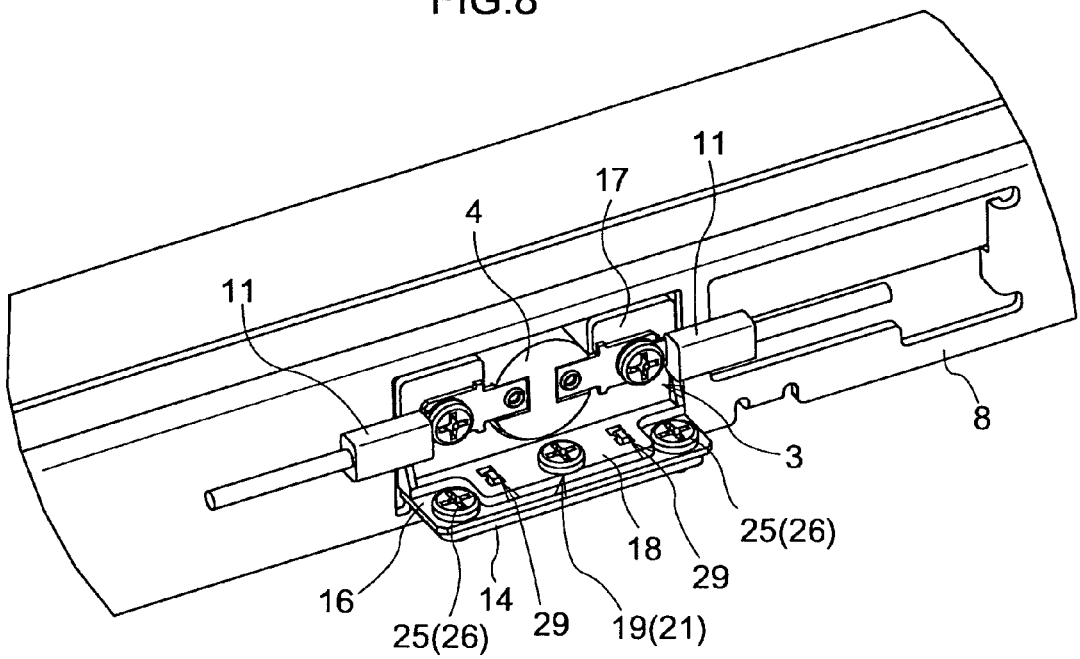
FIG. 8 is a perspective view illustrating the method of assembling the member mounting arrangement.
Figure 9:
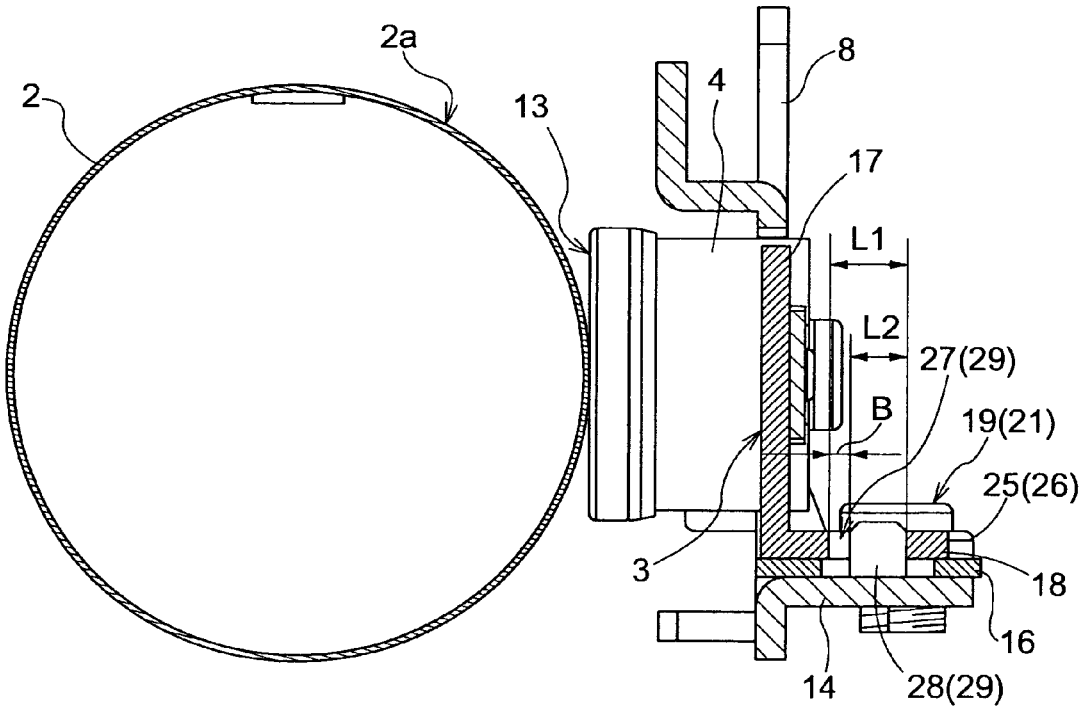
FIG. 9 is a vertical section of principal portions illustrating the method of assembling the member mounting arrangement.
Figure 10:
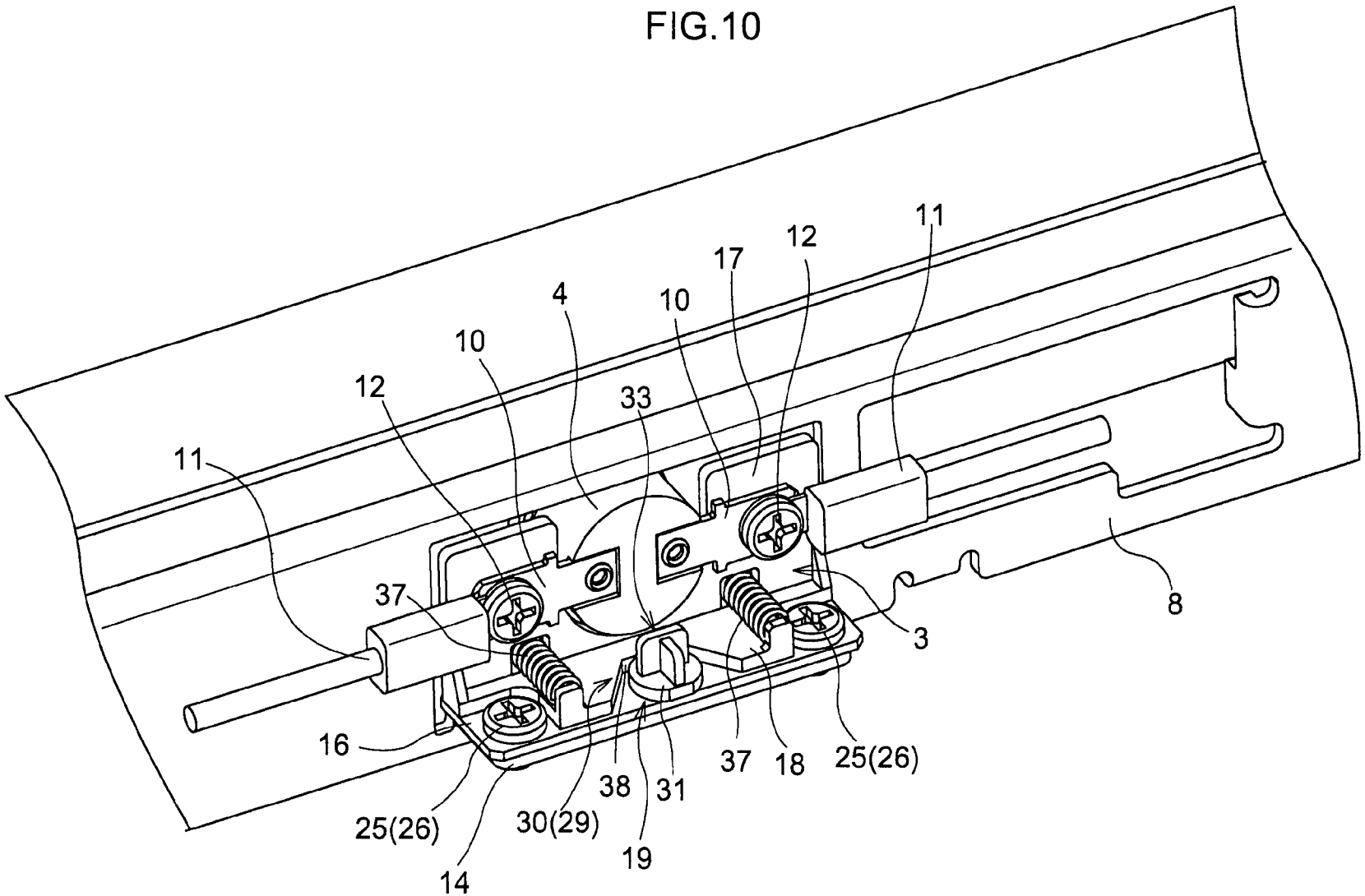
FIG. 10 is a perspective view showing a member mounting arrangement according to a second embodiment of the invention.

Next, as illustrated in FIGS. 8 and 9, with keeping the temperature detecting portion 13 of the thermostat 4 in contact with the outer peripheral surface 2*a* of the fixing roller 2, the screws 25 inserted in the respective adjusting plate through holes 23 will be threaded into the respective female threaded holes 24 of the seat plate 14. With this, the adjusting plate 16 is immovably fastened and fixed to the seat plate 14.

Thereafter, the screw 21 inserted in the bracket through hole 20 will be loosened and, as illustrated in FIGS. 3 and 5, the bracket 3 will be moved until the right and left engaging pawls 28 of the adjusting plate 16 come into contact with the inner peripheral edges of the respective engaging slots 27 on the first plate portion 17 side. With this, the temperature detecting portion 13 of the thermostat 4 is separated away from the outer peripheral surface 2*a* of the fixing roller 2 for the predetermined distance B. Under this condition, the screw 21 inserted in the bracket through hole 20 will be fastened, thereby immovably fixing the adjusting plate 16 to the machine frame 6 via the seat plate 14. With this, the thermostat 4 is mounted at a predetermined position away from the fixing roller 2 for the predetermined distance B.

Second Embodiment

FIGS. 10 through 16 show a further embodiment of the member mounting arrangement according to the invention. In this further embodiment, there is provided a cam mechanism 30 switchable between a contacting condition where the temperature detecting portion 13 of the thermostat 4 is placed in contact with the outer peripheral surface 2*a* of the fixing roller 2 and a separating condition where the temperature detecting portion 13 is placed away from the outer peripheral surface 2*a* of the fixing roller 2 for the predetermined distance B. With an operation on this cam mechanism 30, the thermostat 4 can be mounted at the predetermined position away from the fixing roller 2 for the predetermined distance B.

Referring to the cam mechanism 30 in details, the second plate portion 18 of the bracket 3 is adapted to act as a cam follower and a cam member 33 having a cam plate 31 and a pivot shaft element 32 is supported to the adjusting plate 16 to be pivotable about a vertical axis X. Then, in response to a pivoting operation of the cam member 33, the contacting condition and the separating condition can be switched over therebetween.

Figure 11:
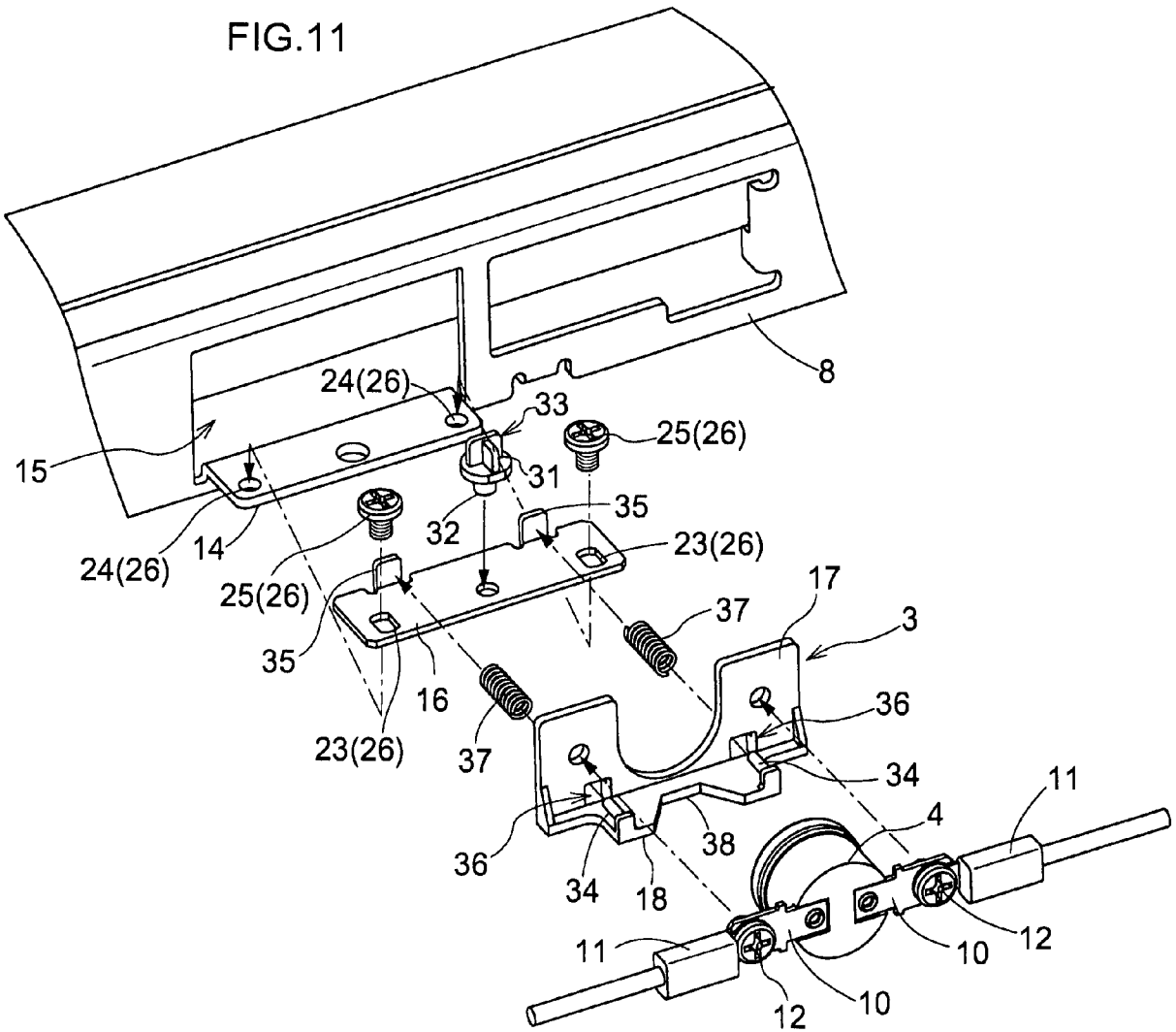
FIG. 11 is an exploded perspective view showing the member mounting arrangement according to the second embodiment.

The second plate portion 18, as shown in FIG. 11, integrally forms, in its upper surface, right and left stem portions 34 projecting toward the fixing roller 2 side. The adjusting plate 16 integrally forms, at the lateral ends on the side of the fixing roller 2, right and left upwardly projecting lugs 35. And, compression coil springs 37 are fitted, through insertion holes 36 defined in the first plate portion 17, between the respective stem portions 34 and the respective lugs 35. The compression coil springs 37 provide an urging force for urging the cam plate 31 of the cam mechanism 30 into contact with the second plate portion 18. In this embodiment, the compression coil springs 37 are configured to exert an urging force for urging the second plate portion 18 away from the fixing roller 2, so that under this urging force, the second plate portion 18 is placed in contact with the cam member 33. With this, the rotational operation of the cam mechanism 30 can be transmitted to the second plate portion 18 in a reliable manner.

Further, as described above, the second plate portion 18 is constructed as a cam follower. More particularly, an end of this second plate portion 18 opposite to and away from the fixing roller 2 side is cutaway in a trapezoidal shape to form a pressed face 38 to be pressed by the cam plate 31, with the pressed face 38 extending substantially parallel with the rotational axis of the fixing roller 2. Therefore, with the simple operation of pivoting the cam member 33, the contacting condition and the separating condition between the fixing roller 2 and the thermostat 4 can be readily switched over.

Figure 12:
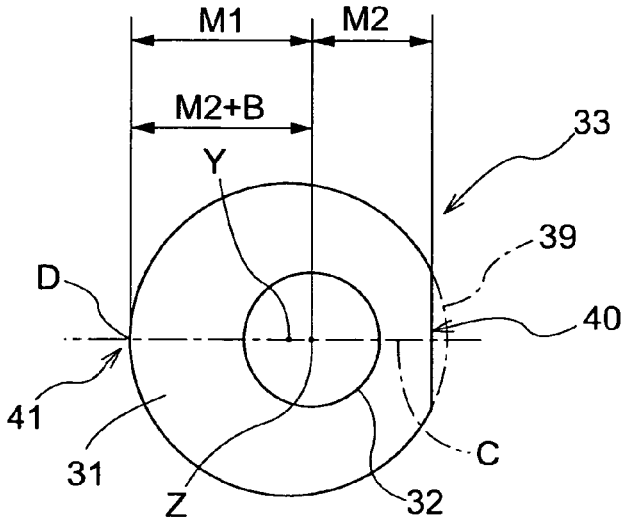
FIG. 12 is a plan view showing principal portions.

Referring to the cam plate 31 in great details, as shown in FIG. 12, an outer peripheral portion of a round disc 39 is cut away along a direction normal to a segment C extending through a disc center Y, into a shape having a flatted end face 40 and this plate is supported to the adjusting plate 16 to be pivotable about a pivot axis X.

And, the pivot axis X of the cam plate 31 is set at a position offset from the disc center Y such that a distance M1 from the disc center Y along the segment C normal to the flattened end face 40 to an arcuate end face 41 is longer, for the predetermined distance B, than a distance M2 extending from the center Y along the segment C to the flattened end face 40. With this, even with a pivoting operation of the cam plate 31 having a small outer diameter, the second plate portion 18 can be moved with a large stroke, thereby realizing switchover from a condition where the pressed face 38 is pressed by the arcuate end face 41 to a condition where the pressed face 38 is pressed by the flattened end face 40. In this way, there is realized the cam mechanism 30 capable of switching over between the contacting condition where the thermostat 4 is placed in contact with the fixing roller 2 and the separating condition where the thermostat 4 is placed away from the fixing roller 2.

Incidentally, under the separating condition, the separating or "separable" distance between the fixing roller 2 and the thermostat 4 is determined by the cam profile of the cam member 33 constituting the cam mechanism 30. Therefore, through appropriate selection of the profile of the cam plate 31 of the cam member 33, the separable distance can be readily set to a desired value.

Also, in the setting of the pivot axis X of the cam plate 31, the distance M2 from the disc center Y to the flattened end face 40 may be set such that the pivot axis X coincides with the disc center Y.

Therefore, as described hereinbefore, the adjusting plate 16 corresponds to the intermediate fixing member to be attached to be movable to/away from the fixing roller 2. The second plate portion 18 is attached to the adjusting plate 16 to be movable in the same moving direction of the adjusting plate 16 in response to a pivoting operation on the cam plate 31. And, the range of the movement of the thermostat 4 is set such that the temperature detecting portion 13 of the thermostat 4 can be placed into contact with the fixing roller 2, with the second plate member 18 being attached to the adjusting plate 16.

In this further embodiment, the cam mechanism 30 acts also as the regulating portion 29 for regulating, to the predetermined range, the separating distance B for separating the thermostat 4 contacting the fixing roller 2 away from this fixing roller 2. That is, with the presence of this cam mechanism 30, the second plate portion 18 supporting the thermostat 4 is prevented from being moved beyond the cam plate 31 of the cam mechanism 30, whereby the separating distance B is regulated or limited to the predetermined range.

Next, there will be described a process of mounting the thermostat 4 secured to the bracket 3 to the seat plate 14.

Figure 13:
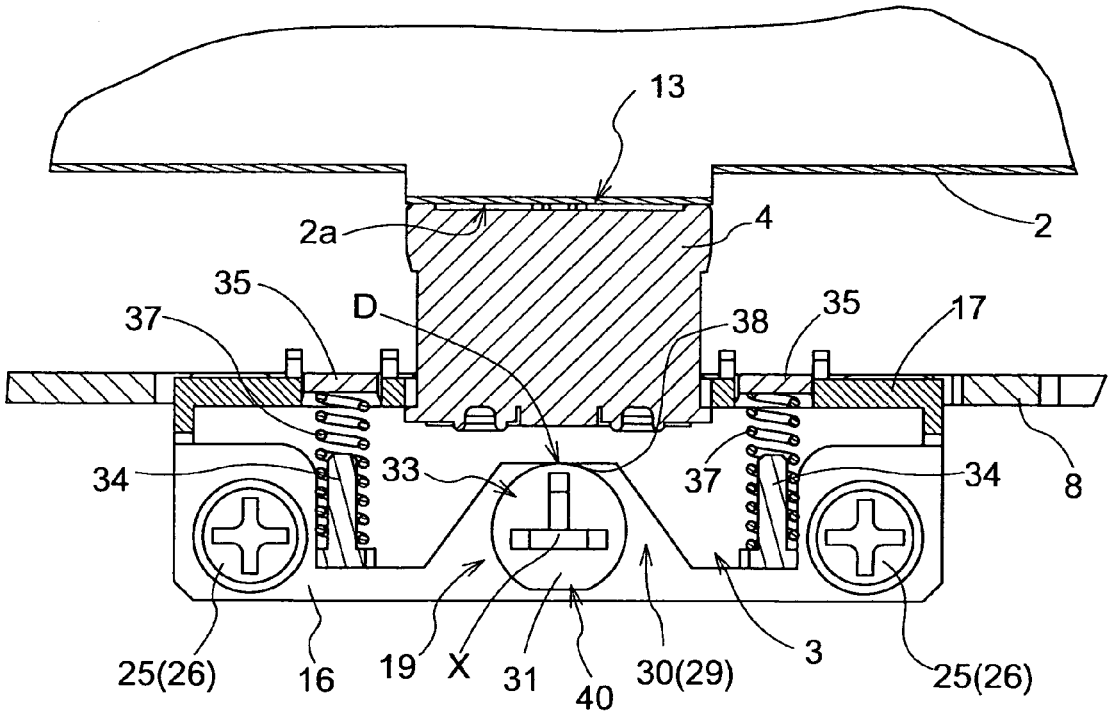
FIG. 13 is a plan view of principal portions illustrating a method of assembling the member mounting arrangement.
Figure 14:
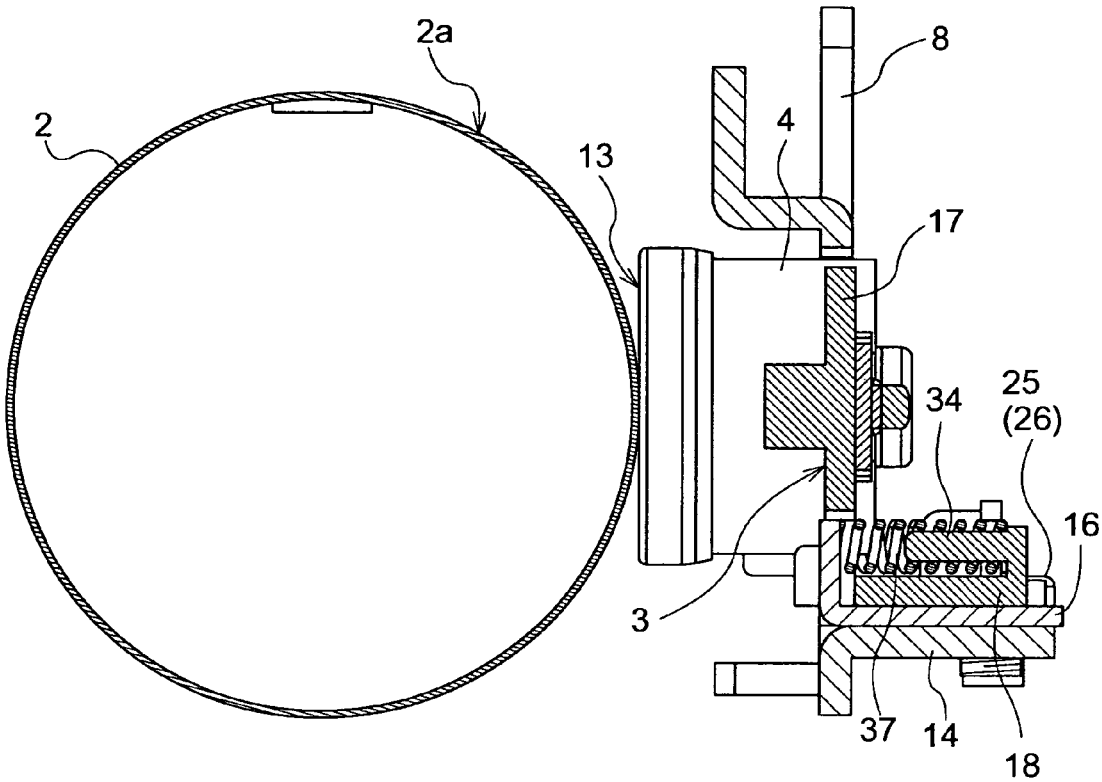
FIG. 14 is a vertical section of principal portions illustrating the method of assembling the member mounting arrangement.

As illustrated in FIGS. 13 and 14, the bracket 3 to which the thermostat 4 is fixed will be assembled with the adjusting plate 16 via the compression springs 37, so that the pressed face 38 of the second plate portion 18 will be pressed by the arcuate end face 41 of the cam plate 31 at an intersection portion D thereof intersecting the segment C shown in FIG. 12. Next, with keeping the temperature detecting portion 13 of the thermostat 4 in contact with the outer peripheral surface 2*a* of the fixing roller 2, the screws 25 inserted in the respective adjusting plate through holes 23 will be threaded into the associated female threaded holes 24 of the seat plate 14, thus immovable screw-fixing the adjusting plate 16 to the seat plate 14.

Figure 15:
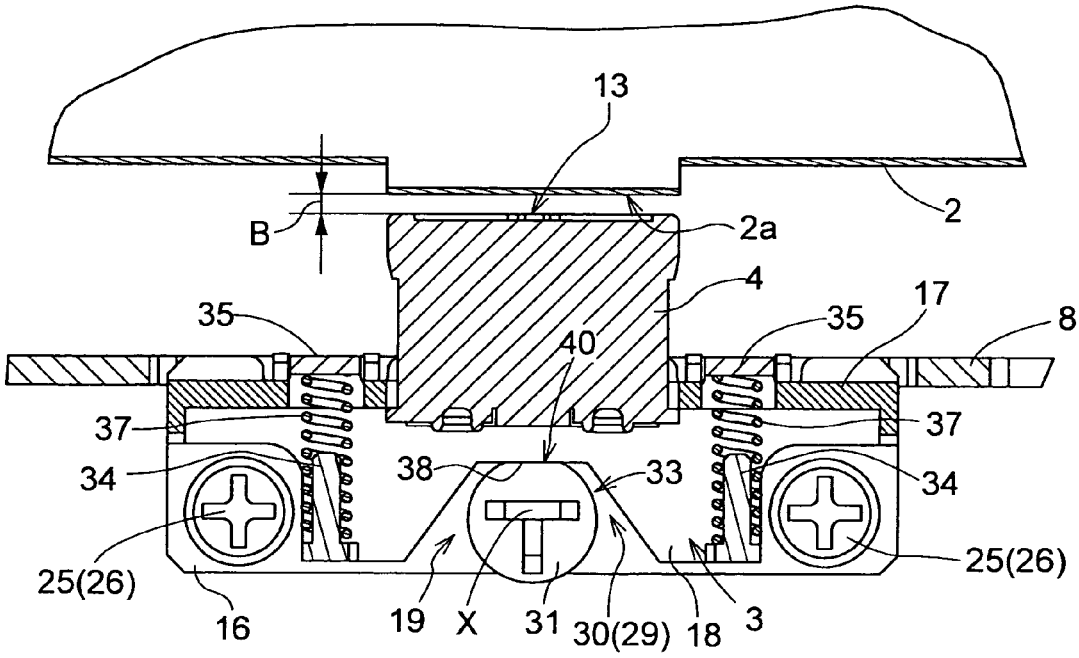
FIG. 15 is a plan view of principal portions illustrating the method of assembling the member mounting arrangement.
Figure 16:
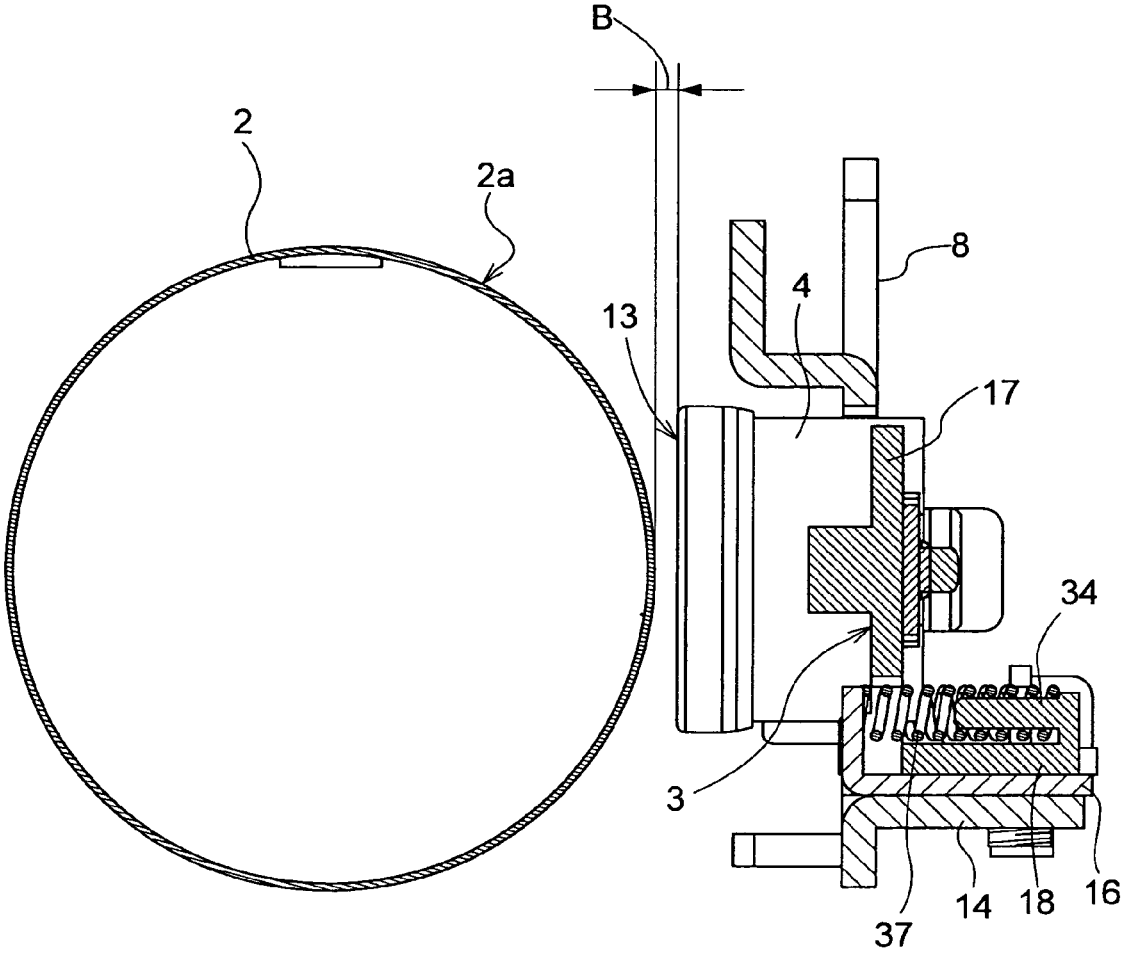
FIG. 16 is a vertical section of principal portions illustrating the method of assembling the member mounting arrangement.

Thereafter, as illustrated in FIGS. 15 and 16, the cam plate 31 will be pivoted so as to cause the pressed face 38 of the second plate portion 18 to be pressed by the flattened end face 40 of the cam plate 31, whereby the temperature detecting portion 13 of the thermostat 4 will be moved away from the outer peripheral surface 2*a* of the fixing roller 2 for the predetermined distance B. In the course of this, as the pressed face 38 is kept pressed against the flattened end face 40 of the cam plate 31, the second plate portion 18 will be fixed to the adjusting plate 16 and the thermostat 4 will be mounted at a predetermined position separated from the fixing roller 2 for the predetermined distance B. In this way, in this further embodiment, when the cam mechanism 30 is under the inoperative, i.e. stopped condition, relative movement between the adjusting plate 16 and the second plate portion 18 is prevented reliably by means of the urging force of the compression coil springs 37. Therefore, the positioning operation by the second fixing portion can be carried out reliably and easily.

The rest of the construction of this second embodiment is identical to the first embodiment.

Other Embodiments

<1> In the second embodiment, the compression coil springs 37 are provided, and the second plate portion 18 is caused to act as a cam follower by the urging force of these coil springs 37. Instead, the second plate portion 18 can be adapted to act as a cam follower relative to the cam member 33, without using such compression coil springs 37. For instance, the cam plate 31 of the cam member 33 and the second plate portion 18 can be interconnected via a crank mechanism. In this case, when the cam member 33 is pivoted, the pivotal movement is converted into a reciprocating movement by the crank mechanism, which movement then is to be transmitted to the second plate portion 18. Namely, the second plate portion 18 will be rendered movable in the direction to/away from the fixing roller 2. Therefore, through appropriate adjustment of the pivotal amount of the cam member 33, the separating distance between the fixing roller 2 and the thermostat 4 can be adjusted to a desired value.

<2> The member mounting arrangement of the present invention can be embodied as a member mounting arrangement wherein a rotor of a rotation sensor is provided as the "proximity object", a magnetism sensor having a detecting face for detecting change in magnetism is provided as the "proximity mounting member" and the magnetism sensor is to be mounted so that the detecting face thereof is disposed away from the rotor for a predetermined distance relative thereto. In this way, in the present invention, the specific combination and use of the proximity object and the proximity mounting member to be mounted away from the proximity object for the predetermined distance are not particularly limited.

The invention claimed is:

1. A member mounting arrangement for mounting a proximity mounting member to a proximity object at a predetermined position relative thereto, the arrangement comprising:

an intermediate fixing member attached to a fixing frame supporting the proximity object, the intermediate fixing member being adjustable in position in a direction to/from the proximity object;

a fixing connecting portion attached to said intermediate fixing member while supporting the proximity mounting member, the fixing connecting portion being adjustable in position in said direction;

a regulating portion for regulating a separating distance between the proximity mounting member and the proximity object to a predetermined range;

a first fixing portion for fixing said intermediate fixing member in position relative to said fixing frame; and a second fixing portion for fixing said fixing connecting portion in position relative to said intermediate fixing member, wherein said regulating portion includes a slot provided in one of said intermediate fixing member and said fixing connecting portion and an engaging pawl provided in the other and engageable in said slot.

2. A member mounting arrangement for mounting a proximity mounting member to a proximity object at a predetermined position relative thereto, the arrangement comprising:

an intermediate fixing member attached to a fixing frame supporting the proximity object, the intermediate fixing member being adjustable in position in a direction to/from the proximity object;

a fixing connecting portion attached to said intermediate fixing member while supporting the proximity mounting member, the fixing connecting portion being adjustable in position in said direction;

a regulating portion for regulating a separating distance between the proximity mounting member and the proximity object to a predetermined range;

a first fixing portion for fixing said intermediate fixing member in position relative to said fixing frame; and a second fixing portion for fixing said fixing connecting portion in position relative to said intermediate fixing member, wherein said intermediate fixing member and said fixing connecting portion together provide a cam mechanism which is switchable between a contacting condition where the proximity mounting member is placed in contact with the proximity object and a separating condition where the proximity mounting member is placed away from the proximity object, said cam mechanism acting also as said regulating portion.

3. The member mounting arrangement according to claim 2, further comprising an urging member for urging said cam mechanism and said fixing connecting portion into contact with each other.

* * * * *

UNITED STATES PATENT AND TRADEMARK OFFICE

CERTIFICATE OF CORRECTION

PATENT NO. : 8,041,260 B2
APPLICATION NO. : 11/643290
DATED : October 18, 2011
INVENTOR(S) : Takeshi Yoshida It is certified that error appears in the above-identified patent and that said Letters Patent is hereby corrected as shown below:

Title Page, Column 1, Item (54), Line 1, after "ARRANGEMENT" insert -- FOR A HEAT SENSOR OF A FIXING DEVICE --

Column 1, Line 1, after "ARRANGEMENT" insert -- FOR A HEAT SENSOR OF A FIXING DEVICE --

Signed and Sealed this
Sixth Day of March, 2012

David J. Kappos

David J. Kappos
*Director of the United States Patent and Trademark Office*